United States Patent [19]

Patel

[11] 4,034,593

[45] July 12, 1977

[54] CRIMPING MACHINE WITH AUTOMATIC SWING OPEN PUSHERS

[75] Inventor: Hiralal V. Patel, Euclid, Ohio

[73] Assignee: The Weatherhead Company, Cleveland, Ohio

[21] Appl. No.: 675,270

[22] Filed: Apr. 9, 1976

[51] Int. Cl.[2] ..... B21D 39/00

[52] U.S. Cl. ..... 72/402; 29/237

[58] Field of Search ..... 72/402, 316, 317, 399; 29/237

[56] References Cited

U.S. PATENT DOCUMENTS

| | | | |
|---|---|---|---|
| 2,381,748 | 8/1945 | Howe | 29/237 |
| 3,072,174 | 1/1963 | Vanderhoof | 29/237 |
| 3,706,123 | 12/1972 | Whitledge | 29/237 |
| 3,750,452 | 8/1973 | Frank | 29/237 |
| 3,762,209 | 10/1973 | Herndon | 29/237 |
| 3,851,514 | 12/1974 | Chen | 29/237 |

*Primary Examiner*—C.W. Lanham
*Assistant Examiner*—Gene P. Crosby
*Attorney, Agent, or Firm*—McNenny, Pearne, Gordon, Gail, Dickinson & Schiller

[57] ABSTRACT

A crimping machine for radially inwardly crimping an end fitting onto a hose by means of a contractible die assembly includes a reciprocable ram. A pusher assembly is mounted on the ram for transmitting ram force to the die assembly. The pusher assembly includes first and second semicircular pusher members, and each pusher member is mounted for axial movement with the ram and for lateral swinging movement relative to the ram about a pivot axis which is parallel to the longitudinal axis. The die assembly includes two disjuncted die sections, one of which is carried on the end of each pusher member by an attachment arm which is deflectable to permit radial movement of the die sections relative to the pusher members. The attachment arm is provided with manually deflectable tabs which secure the die sections in place during crimping and which are deflectable to permit removal and replacement of the die sections. The pusher members are opened and closed by a camming arrangement which includes cam rollers on each pusher member and a stationary cam surface having an arcuate lateral cross section to provide proper camming as the pusher members and cam followers swing about the pusher member pivot axis.

16 Claims, 11 Drawing Figures

Fig. 1
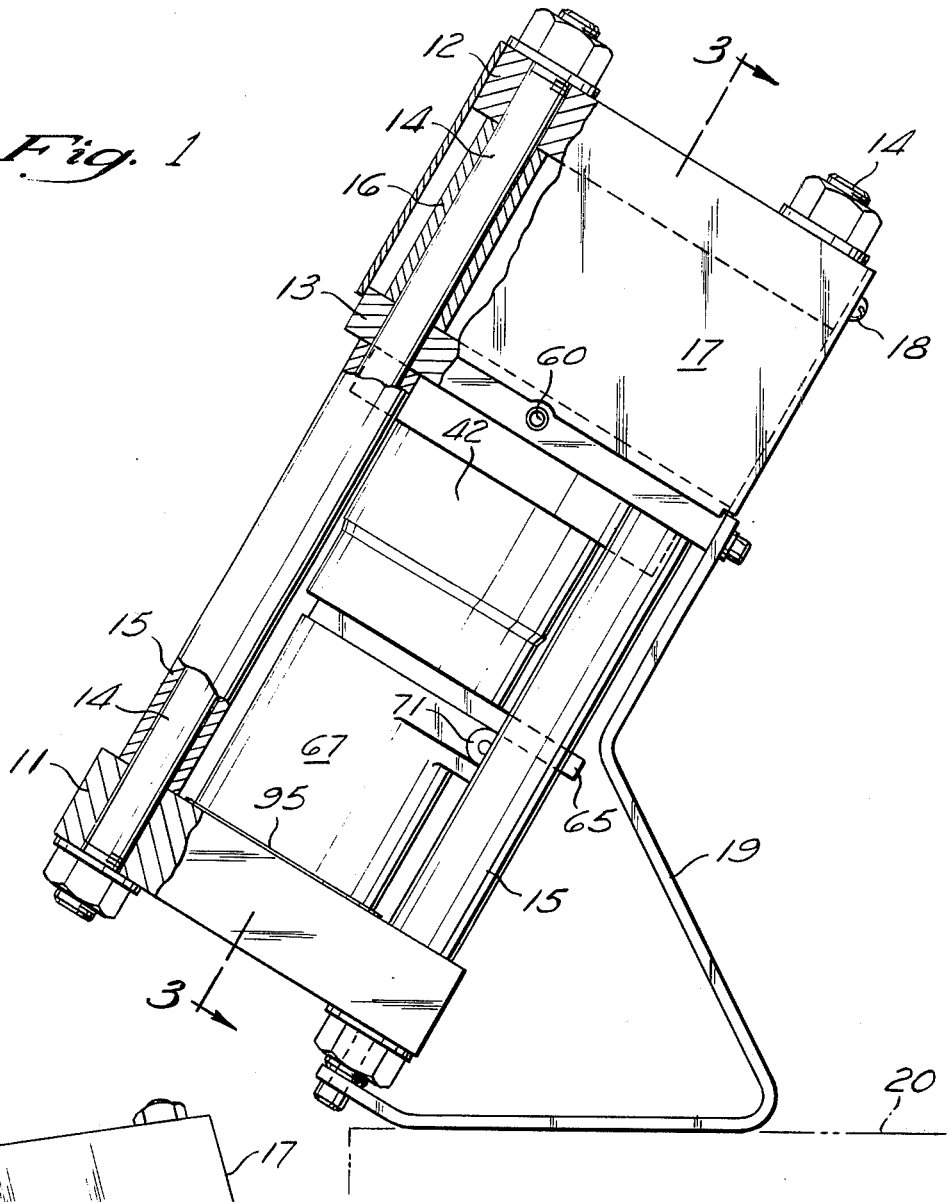
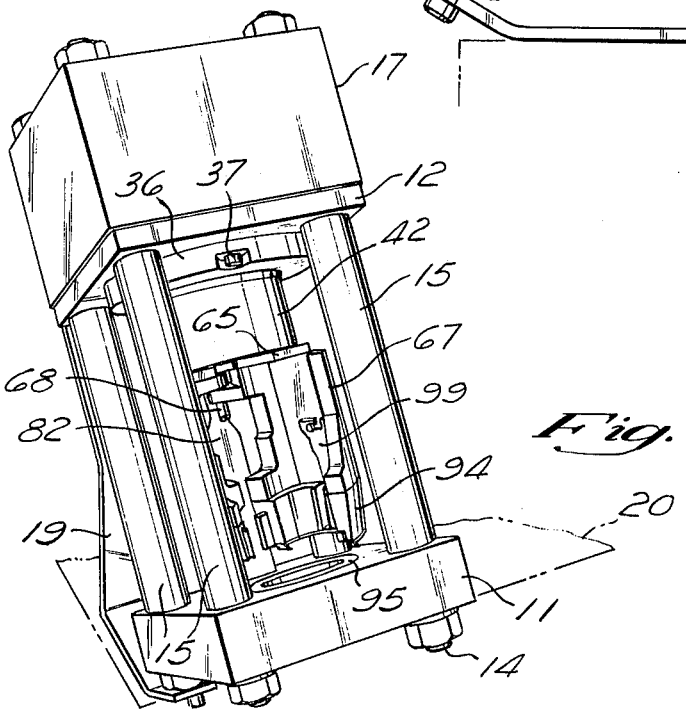
Fig. 2

Fig. 3
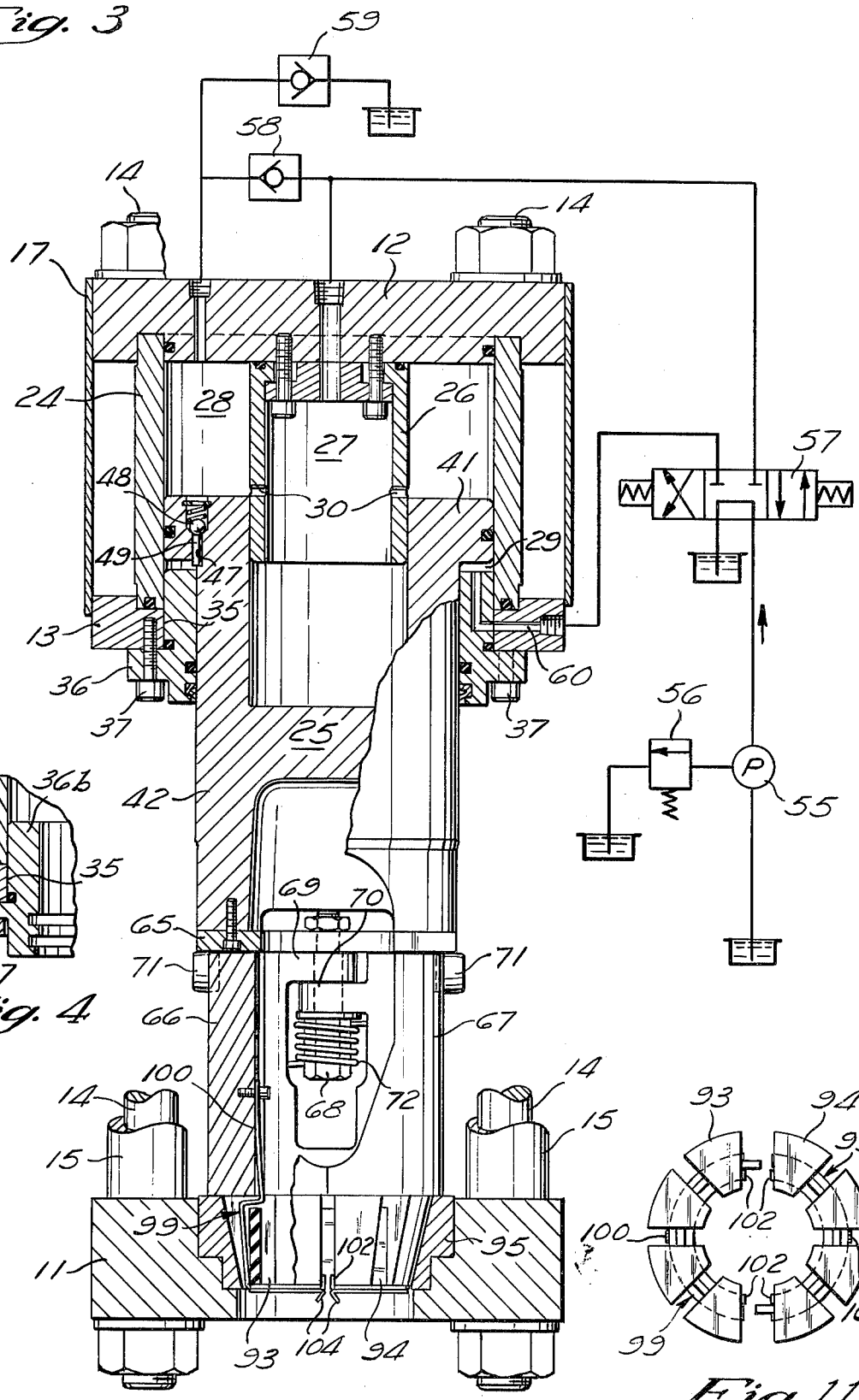
Fig. 4
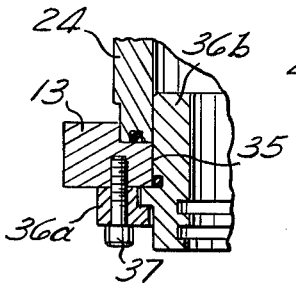
Fig. 11

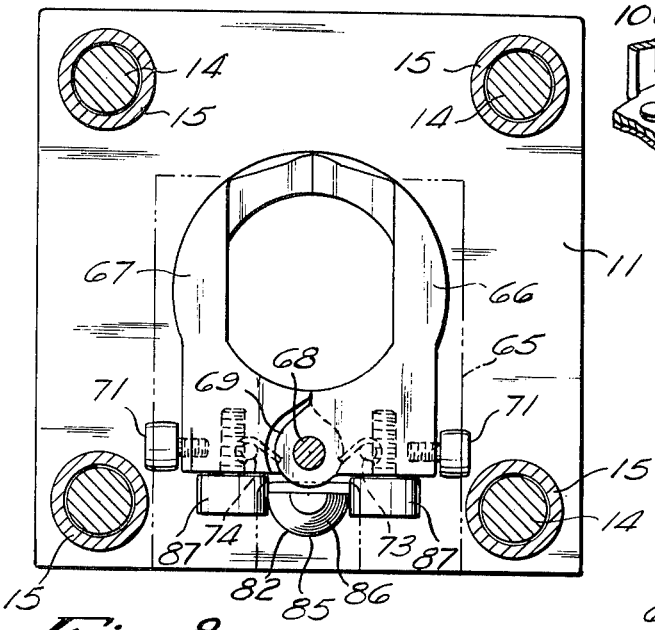
Fig. 8
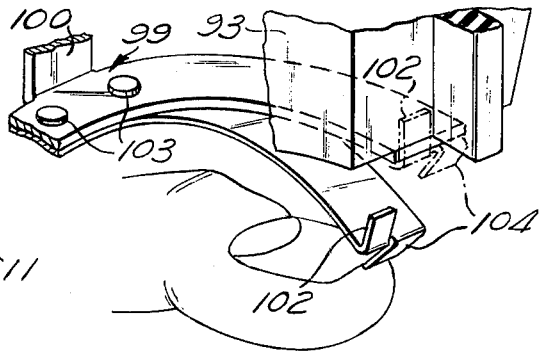
Fig. 10
Fig. 5
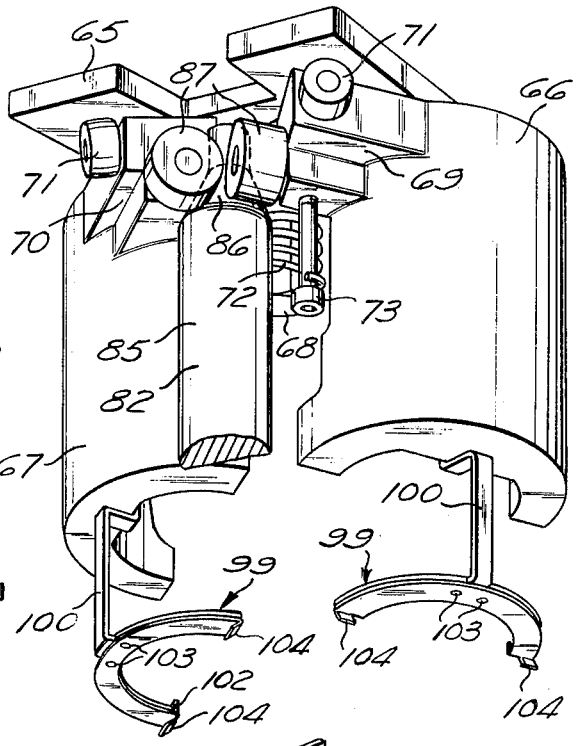
Fig. 6
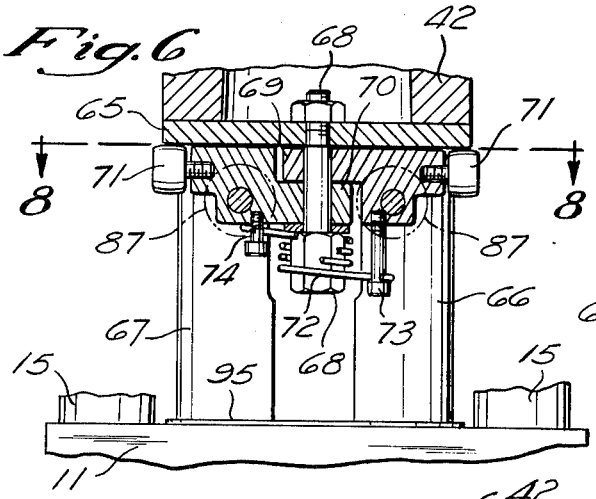
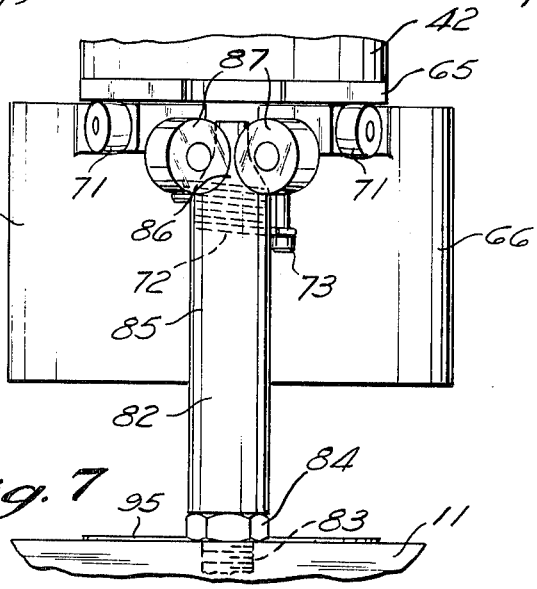
Fig. 7
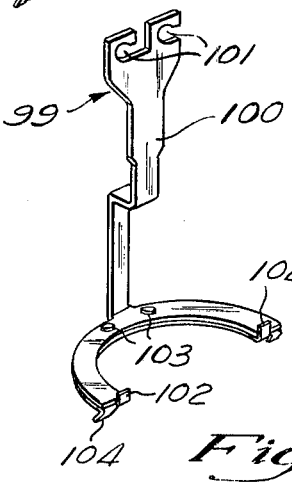
Fig. 9

CRIMPING MACHINE WITH AUTOMATIC SWING OPEN PUSHERS

BACKGROUND OF THE INVENTION

The present invention relates to a machine for crimping an end fitting onto a hose. More particularly, the invention relates to such a machine which is capable of crimping a wide variety of types and sizes of end fittings onto a wide variety of types and sizes of hoses and which can be quickly and easily changed from one type and size to another.

The prior art has provided a number of machines for radially inwardly deforming a workpiece. One crimping machine which incorporates two pusher members between a hydraulic ram and a die assembly which can be swung open to permit removal of the workpiece and die assembly is disclosed in U.S. Pat. No. 3,851,514.

Another crimping machine is disclosed in U.S. patent application Ser. No. 672,295, filed Mar. 31, 1976, and assigned to the assignee of this application. This pending application discloses a crimping machine which incorporates two pusher members between a hydraulic ram and a die assembly which can be swung open about a lateral axis which extends from front to back of the machine. The die assembly includes two die sections which are removably connected to the pusher members. After a crimping operation is completed, the pusher members retract and pull the die sections from the socket. A camming arrangement then swings the pusher members and die sections laterally outwardly to permit removal of the workpiece and die assembly.

SUMMARY OF THE INVENTION

The present invention departs from these and other prior art machines by providing a crimping machine in which; (a) a die section holder having a deflectable attachment arm removably secures each die section to its associated pusher member; (b) an annular seal cartridge is removably secured to the cylinder in which the ram is disposed, and a valve prevents excessive forces from being exerted on the annular seal cartridge; and (c) the pusher members are provided with cam followers which ride against a common cam surface of arcuate lateral cross-section for swinging the pusher members open and closed.

According to the first feature of the invention, a mounting device for removably mounting the die sections on the pusher members includes a deflectable attachment arm having a first end secured to the pusher member and having a second end with alignment tabs for aligning and attaching the die section in a predetermined position relative to the attachment arm. The second end of the attachment arm is in a free radially outwardly position when the die section is removed from the socket, and the second end of the attachment arm is moved to a deflected position radially inward of the free radially outward position when the die section is fully received in the socket. This permits movement of the die section relative to the pusher member during crimping of the workpiece. The alignment tabs are manually deflectable from a free position obstructing removal of the die section to a deflected position permiting removal of the die section from the attachment arm.

The second feature of the invention provides a hydraulic force transmitting device for the crimping machine which includes a hydraulic cylinder disposed between two end plates which are secured together by a plurality of tie rods. A larger diameter head portion of the ram is slidably disposed within the cylinder. An annular seal cartridge is removably secured to the hydraulic cylinder and provides a smaller diameter opening through which a piston portion of the ram projects. This arrangement permits removal of the ram from the cylinder for replacement of the seals or for other maintenance without loosening the several tie rods and separating the cylinder end plates. In order to prevent excessive longitudinal forces on the seal cartridge, a valve device which is responsive to the position of the ram during advancing movement of the ram and which is responsive to hydraulic pressure in the return chamber during retraction of the ram limits the longitudinal force which can be exerted on the seal cartridge.

The third feature of applicant's invention provides a camming device which includes a stationary cam surface of arcuate lateral cross-section. A cam follower on each of the pusher members rides on the stationary cam surface and moves circumferentially about the arcuate cam surface as the pusher members swing open and closed. This permits a very simple stationary camming surface to define the path of travel of the pusher members which swing open and shut as the ram reciprocates.

BRIEF DESCRIPTION OF THE DRAWINGS

These and other features and advantages of the invention will be apparent to those skilled in the art upon an understanding of the preferred embodiment of the invention shown in the accompanying drawings, wherein:

FIG. 1 is a side elevational view of the machine according to the principals of the invention with the ram in a fully advanced position;

FIG. 2 is a perspective view of the machine shown in FIG. 1 with the ram in a fully retracted position;

FIG. 3 is a longitudinal cross-sectional view taken along reference view line 3—3 in FIG. 1, with portions shown in elevation and with the hydraulic circuit shown schematically;

FIG. 4 is a longitudinal cross-sectional view showing an alternate seal cartridge for the machine shown in FIG. 1;

FIG. 5 is a partial perspective view showing the arrangement of the pusher members and camming device for the machine shown in FIG. 1;

FIG. 6 is a partial rear elevational view of the machine shown in FIG. 1, with the ram in its fully advanced position and with the ears of the pusher members shown in cross-section;

FIG. 7 is a partial rear elevational view of the machine shown in FIG. 1, with the ram shown in its fully retracted position and with the die sections and mounting devices therefor removed;

FIG. 8 is a cross-sectional view taken along reference view line 8—8 in FIG. 6, with the ram plate shown in phantom outline;

FIG. 9 is a perspective view of the mounting device for mounting each die section on its associated pusher member;

FIG. 10 is an enlarged perspective view of a portion of the mounting device shown in FIG. 9 with the alignment tabs shown in a manually deflected position; and FIG. 11 is a top plan view of the die sections carried on the mounting devices.

DETAILED DESCRIPTION OF THE DRAWINGS

Referring now to the drawings in greater detail, FIGS. 1 and 2 show a crimping machine which includes a bed plate 11, an upper end plate 12, and a lower end plate 13. The plates 11, 12 and 13 are each generally flat rectangular steel plates which are bolted together by four identical tie bars 14 and which are spaced apart by four identical lower spacer sleeves 15 and four identical upper spacer sleeves 16. An open ended box-like cover plate 17 is secured to the upper end plate 12 by suitable threaded fasteners 18.

Two identical mounting brackets 19 are suitably fastened at their upper end to the end plate 13 and at their lower end to one of the tie bars 14. The mounting brackets 19 mount the crimping machine on a horizontal work surface 20 so that the longitudinal axis of the ram is tilted at an angle of approximately 30° to the vertical and so that the bottom of the bed plate 11 is unobstructed.

Referring now to FIG. 3, an annular hydraulic cylinder 24 extends between the end plates 12 and 13. Each end of the hydraulic cylinder 24 is sealingly received in a suitable annular grove in its adjacent end plate 12 or 13 to provide a fluid tight seal therebetween. A ram or piston 25 is slidably disposed within the hydraulic cylinder 24 and is movable toward and away from the bed plate 11. An internal cylinder 26 is rigidly secured to the upper end plate 12 by suitable bolts and is provided with an annular seal for sealingly engaging the upper end plate 12. The cylinder 24 and ram 25 and internal cylinder 26 cooperatively define a first advancing fluid pressure chamber 27, a second advancing fluid pressure chamber 28, and an annular retracting fluid pressure chamber 29. A plurality of radial passages 30 in the internal cylinder 26 establish open fluid pressure communication between the first and second advancing fluid pressure chambers 27 and 28 when the ram 25 approaches its fully advanced position.

The lower end plate 13 is provided with a circular opening 35 which has a diameter of at least as great as the internal diameter of the cylinder 24. An annular ring like seal cartridge 36 is disposed in the opening 35 and is bolted to the lower end plate 13 by a plurality of circumferentially spaced bolts 37. The seal cartridge 36 carries on its exterior diameter a suitable seal which seals against the opening 35 to prevent fluid leakage between the cylinder 24 and the seal cartridge 36. The seal cartridge 36 also includes a cylindrical inner wall which is of substantially smaller diameter than the diameter of the inner wall of the hydraulic cylinder 24 and which carries a seal and wiper ring.

An alternative embodiment of the seal cartridge 36 is illustrated in FIG. 4. In the alternative embodiment, the seal cartridge is of two piece construction and includes an annular clamping ring 36*a* and an annular seal carrier 36*b*. The alternate embodiment of the seal cartridge shown in FIG. 4 may be used to reduce the cost of manufacturing the seal cartridge, because the tubing used in the alternate embodiment has a smaller wall thickness and is more readily available commercially than the tubing used in the FIG. 3 embodiment of the seal cartridge.

Referring again to FIG. 3, the ram 25 includes a head portion 41 which is sealingly and slidably disposed within the hydraulic cylinder 24. The ram 25 also includes a cylindrical rod portion 42 of substantially smaller diameter than the head portion 41. The rod portion 42 extends through the opening 35 in the lower end plate 13 and is slidably disposed in the inner cylindrical portion of the seal cartridge 36. The seal and wiper carried on the inner cylindrical portion of the seal cartridge 36 prevent fluid leakage between the seal cartridge 36 and the rod portion 42 during reciprocating movement of the ram 25.

This arrangement of the seal cartridge 36 permits removal of the entire ram 25 from the cylinder 24 without disconnecting the tie bars 14. When the ram plate and pusher members described below are removed from the ram 25, the bolts 37 are removed to permit removal of the seal cartridge 36. Because the opening 35 in the lower end plate 13 is of a diameter which is at least as great as the diameter of the inner wall of the cylinder 24, the head portion 41 may be lowered through the opening 35 for complete removal of the ram 25 from the cylinder 24. The seals on the ram 25 and seal cartridge 36 may then be replaced, and the machine may be reassembled.

Still referring to FIG. 3, a passage 47 extends through the head portion 41 of the ram 25 between the advancing fluid pressure chamber 28 and the retracting fluid pressure chamber 29. The passage 47 is a stepped bore with a valve seat at the junction of its larger diameter portion and smaller diameter portion. A ball 48 is disposed in the passage 47 and is urged against the valve seat by a spring which is held in place by a suitable snap ring. An actuating rod 49 is also disposed in the passage 47.

This structure provides a valve device which is responsive to the position of the ram 25 relative to the seal cartridge 36 during advancing movement of the ram 25 to prevent excessive forces on the seal cartridge 36. If the crimping die sections or die ring described below or the ram plate and pusher members described below are removed from the ram 25, the ram 25 could advance downwardly beyond the position shown in FIG. 3 by fluid pressure in the first and second advancing chambers 27 and 28. If this occurs, the actuating rod 49 engages the seal cartridge 36 and lifts the ball 48 from its associated seat. This establishes a drain connection from the first and second advancing chambers 27 and 28 through the passage 47 and through the retracting chamber 29 which is connected to the reservoir during advancing of the ram 25 as further described below. This releases the pressure in the advancing chambers 27 and 28 and prevents such pressure acting against the piston head portion 41 from creating an excessive force against the seal cartridge 36.

This valve device is also responsive to the fluid pressure in the retracting chamber 29 during retraction of the ram 25 to prevent excessive fluid pressure in the retracting chamber 29 from creating an excessive force on the seal cartridge 36. This is because the spring which acts on the ball 48 permits the ball 48 to move away from its associated seat when the pressure in the retracting chamber reaches a predetermined maximum pressure, such as could occur when the fully retracted ram 25 engages the upper end plate 12. When this occurs, fluid from the retracting fluid pressure chamber 29 is vented to the reservoir through the passage 47 and through the advancing chambers 27 and 28 which are connected to the reservoir during retraction of the ram 25 as described further below.

The fluid power circuit for advancing and retracting the piston 25 is also shown in FIG. 3. The fluid power circuit includes a suitable electric motor driven hydraulic pump 55 having a relief valve 56 which in the preferred embodiment is set at approximately 4,100 psi. The circuit also includes a manually actuated three position four way selector valve 57 and two one-way check valves 58 and 59.

In order to retract the ram 25 from its fully advanced position shown in FIG. 3, the valve 57 is moved to the right. This connects the output of the pump 55 to the retracting chamber 29 through a radial passage 60 in the lower end plate 13 and through a suitable radial and axial passage in the seal cartridge 36 which is aligned with the passage 60. This also connects the advancing chambers 27 and 28 to the reservoir to permit retraction of the ram 25.

When the ram 25 is in its fully retracted position with the piston head portion 41 adjacent to the upper end plate 12, the valve 57 is moved to the left to advance the ram 25. This connects the first advancing chamber 27 to the output of the pump 55 and connects the retracting chamber 29 to the reservoir. During the portion of the advancing movement of the ram 25 in which the passages 30 in the internal cylinder 26 are covered by confronting surfaces of the ram 25, the ram 25 advances rapidly. This is because the output of the pump 55 only has to fill the first advancing chamber 27, since the second advancing chamber 28 draws fluid from the reservoir through the one-way check valve 59. Near the end of the advancing stroke of the ram 25, the passages 30 are uncovered by the ram 25 to hydraulically connect the first and second advancing chambers 27 and 28. Fluid from the pump 55 then is supplied to both the first chamber 27 and, through the passages 30, the second advancing chamber 28 so that the pump pressure acts on the entire lateral cross-sectional area of the head portion 41. When the fully advanced position shown in FIG. 3 is reached, the relief valve 56 opens and the operator returns the valve 57 to its center position.

Referring now to FIGS. 3, 5 and 8 together, a generally flat H-shaped ram plate 65 is bolted to the lower end of the ram 25 by a plurality of suitable bolts. The ram plate 65 is rigidly connected to and moves with the ram 25 under all conditions. Two generally semicircular pusher members 66 and 67 are pivotally secured to the ram plate 65 by a suitable bolt 68. The pusher members 66 and 67 include ear portions 69 and 70, respectively. The bolt 68 extends through the ear portions 69 and 70 and through the ram plate 65 to pivotally connect the pusher members 66 and 67 to the ram plate 65. Each ear portion 69 and 70 also includes a support roller 71 which rolls on the bottom surface of the ram plate 65 to reduce any tilt of the pusher members 66 and 67 as they swing open and closed about the pivot bolt 68. The support roller 71 are arranged so that they do not bear any load transmitted from the ram 25 to the die assembly through the pusher members 66 and 67. In this manner, the pusher members 66 and 67 are pivotally secured to the ram 25 for longitudinal movement with the ram 25 and for lateral swinging movement about a pivot axis of the pivot bolt 68 which is parallel to and spaced from the longitudinal axis of the ram 25. This permits the pusher members 66 and 67 to be open to a laterally disposed position when the ram 25 is retracted to fully expose the die assembly to permit removal of the workpiece or changing of the die assembly as discussed further below. This arrangement also permits the pusher members 66 and 67 to be closed together to a ram force transmitting position in which they transmit force from the ram 25 to the die assembly to crimp a workpiece when the ram 25 is advanced.

As best shown in FIGS. 3, 5 and 6, a coil spring 72 spring biases the pusher members 66 and 67 to the open or laterally disposed position. The spring 72 is disposed on the head of the pivot bolt 68. The lower end of the spring 72 is wrapped around a machine screw 73 which is threadably fastened to the ear portion 69 of the pusher member 66. Similarly, the upper end of the spring 72 is wrapped around a machine screw 74 which is threaded into the ear portion 70 of the pusher member 67. The spring 72 is tensioned in a direction such that it pushes backward on the machine screws 73 and 74 to urge the pusher members 66 and 67 to their open positions.

Referring now to FIGS. 5 and 7, a generally semicircular stationary cam member 82 has a cylindrical threaded end portion 83 which is received in a suitable threaded opening in the bed plate 11 and which is secured against rotational movement by a jam nut 84. The stationary cam member 82 includes a first camming portion 85 of predetermined longitudinal extent having a substantially uniform arcuate cross-section. The first camming portion 85 holds the pusher members 66 and 67 in their closed force transmitting positions during a portion of the longitudinal movement of the ram 25.

The stationary cam member 82 also includes a second camming portion 86 of predetermined longitudinal extent which has a conical surface interconnecting and smoothly blended into the cylindrical portions of the cam. The second camming portion 86 extends circumferentially through an angle which is at least as great as the total angle through which the two pusher members 66 and 67 move from their force transmitting positions to their laterally disposed positions. This insures that the cam followers on the pusher members 66 and 67 (discussed further below) confront a surface of the second camming portion 86 continuously as the pusher members 66 and 67 swing between their laterally disposed positions and their force transmitting positions. The second camming portion 86 defines the lateral swinging movement of the pusher members 66 and 67 between their force transmitting positions and their laterally disposed positions.

A cam follower 87 is secured to each of the ear portions 69 and 70 of the pusher members 66 and 67 for movement therewith. The cam followers 87 each include a rotatable wheel carried by a bearing which is secured to its associated ear portion. When the ram 25 and ram plate 65 are in a fully retracted position shown in FIGS. 5 and 7, the spring 72 and the gravitational force on the pusher members hold the pusher members 66 and 67 in their laterally disposed positions to fully expose the die assembly. The spring 72 also holds the cam followers 87 of each pusher member against the second camming portion 86 of the stationary cam member 82. As the ram 25 and ram plate 65 begin to advance toward the bed plate 11, the cam followers 87 are pushed laterally outwardly by the second camming portion 86. This swings the pusher members 66 and 67 about the pivot bolt 68 to begin closing the pusher members 66 and 67. This movement of the cam followers 87 along the second camming portion 86 occurs during a portion of the movement of the ram 25 in which the die sections are removed from the socket of the die assembly as discussed further below. During further advancing movement of the ram 25 and ram plate 65, the cam followers 87 ride along the first camming portion 85 to hold the pusher members 66 and 67 together in their force transmitting positions.

After the ram 25 and ram plate 65 have reached the fully advanced position shown in FIGS. 3 and 6 to crimp the workpiece, the ram 25 and ram plate 65 are retracted. After the die sections are pulled from the socket of the die assembly the cam followers 87 begin to ride along the second camming portion 86 and the spring 72 opens the pusher members 66 and 67 along a path determined by the changing radius of the second camming portion 86. When the fully retracted position of the ram 25 and ram plate 65 are reached, the pusher members 66 and 67 are fully opened to their laterally disposed positions.

Referring now to FIGS. 2, 3 and 11, the crimping machine also includes a die assembly. The die assembly includes a first die section 93 carried by the pusher member 66, a second die section 94 carried by the pusher member 67, and a die ring or socket 95 carried by the bed plate 11. Each of the die sections 93 and 94 include a plurality of metallic die segments. Each of the die segments includes an externally coned surface for engaging the internally coned surface of the socket 95 and an internal surface which defines a part of a die cavity for receiving a workpiece. Each of the die sections also includes a resilient elastomeric spacer which holds the die segments in predetermined positions of spaced adjacency and which provides a resilient means for moving the die segments radially outwardly after the workpiece is crimped and the ram is retracted.

Referring now to FIGS. 5, 9, 10 and 11, two mounting devices 99 are shown for mounting the die sections 93 and 94 on their respective pusher members 66 and 67. The mounting devices 99 for mounting the die sections 93 and 94 are identical to one another. Each mounting device 99 includes an elongated deflectable attachment arm 100 extending longitudinally away from the ram 25 in a direction toward the bed plate 11. A top or first end of each deflectable attachment arm 100 is provided with two apertures 101 for being rigidly secured to the pusher member by two threaded fasteners a substantial distance away from the die section. This rigid mounting of the top end of each attachment arm 100 a substantial distance away from the die section provides an attachment arm of sufficient longitudinal extent to permit deflection of the attachment arm within its elastic limit to permit radial movement of the die section relative to the pusher member as the die section is pushed into the socket 95 to crimp a workpiece. Radially inward deflection of the bottom or second end of each attachment arm 100 relative to its first end is shown in FIG. 3, wherein the die sections are in their radially inward positions for crimping a workpiece and the second end of each attachment arm 100 is deflected radially inwardly to accommodate the radially inward movement of the die section relative to the pusher member. When the ram 25 is then retracted and the die sections are pulled out of the socket 95, the resilient spacers between the metallic die segments open the die sections radially outwardly, and the second end of each attachment arm 100 moves back to its normal or free radially outward position shown in FIG. 5.

The longitudinally extending portion of each attachment arm 100 which extends below its associated pusher member is disposed between adjacent ones of the metallic die segments radially inwardly of the conical outer surfaces of the metallic die segments. In this manner, each attachment arm 100 extends from the bottom of the pusher member to the bottom of the die section without interfering with the outer conical portions of the die segments which engage the conical socket 95 in the bed plate 11.

At the bottom or second end of each attachment arm 100 is a generally flat C-shaped semicircular portion which extends circumferentially substantially coextensively with the bottom surface of its associated semicircular die section. The generally flat C-shaped portion is provided with a longitudinally upwardly protruding alignment tab 102 at each of its ends. The alignment tabs 102 are riveted to the second end of the deflectable attachment arm 100 by suitable rivets 103. A longitudinally downwardly projecting hook portion 104 is connected to each alignment tab 102 to permit manual deflection of its associated alignment tab. When the alignment tabs 102 are in their free or normal positions relative to the attachment arm 100 as shown in FIGS. 5 and 9, the alignment tabs 102 engage the circumferentially facing exposed ends of the end ones of the metallic die segments of the associated die section. In this manner, the alignment tabs 102 align the die sections in a predetermined position relative to the attachment arms 100 and provide an obstruction which prevents removal of the die sections from the mounting device 99. When the die sections are to be removed from the mounting device 99, the alignment tabs are moved longitudinally from their normal obstructing position to a deflected position relative to the attachment arm 100 as shown in FIG. 10. This is accomplished by manually pushing longitudinally downwardly on the hook portion 104 as shown in FIG. 10. With the alignment tabs 102 in the unobstructing position shown in FIG. 10, each die section can quickly be removed from its mounting device and replaced with another die section for crimping a different size workpiece.

I claim:

1. A machine for radially deforming a workpiece comprising a bed plate, a ram reciprocable along a longitudinal axis toward and away from said bed plate, a die assembly for receiving said workpiece, said die assembly including a sprocket and a die section, said die section including a first predetermined number of disjuncted die segments and resilient means acting between adjacent ones of said die segments, said first predetermined number being greater than two, said die segments each having an internal surface defining a part of a die cavity, and mounting means mounting said first predetermined number of disjuncted die segments and said resilient means for longitudinal movement with said ram into and out of said socket by said reciprocable movement of said ram, said mounting means including a second predetermined number of deflectable attachment arms extending away from said ram in a direction toward said bed plate, said second predetermined number being greater than zero and less than said first predetermined number, said attachment arms each having a first end and a second end, said first end being closer to said ram than said second end and said second end being closer to said bed plate than said first end when said ram is in a retracted position, said second end of said attachment arm being in a free radially outward position when said die section is removed from said socket, and said second end being in a deflected position radially inward of said free radially outward position when said die section is fully received in said socket by operation of said ram to radially inwardly displace said die segments to deform said workpiece.

2. A machine for radially deforming a workpiece as set forth in claim 1 wherein said die section includes a top surface and a bottom surface, and said mounting means includes a C-shaped portion adjacent said second end of said attachment arm extending along said bottom surface of said die section.

3. A machine for radially deforming a workpiece as set forth in claim 1 wherein said mounting means includes aligning means adjacent said second end of said attachment arm aligning said die section in a predetermined position relative to said attachment arm, said aligning means includes at least one deflectable tab on said second end of said attachment arm, said tab being in a free position obstructing removal of said die section from said attachment arm during said reciprocating movement of said ram, and said deflectable tab being in a deflected position longitudinally spaced from said free position during removal of said die section from said second end of said attachment arm.

4. A machine for radially deforming a workpiece as set forth in claim 1 wherein said die section is generally semicircular with said die segments disposed in circumferentially spaced apart relation, and said deflectable attachment arm is disposed circumferentially between adjacent ones of said die segments.

5. A machine for radially deforming a workpiece comprising a bed plate, a ram reciprocable toward and away from said bed plate, a die assembly for receiving said workpiece, and a longitudinally extending pusher member disposed between said ram and said die assembly, said die assembly including a socket and a generally semicircular die section, said die section including a first predetermined number of circumferentially spaced disjuncted die segments and resilient means acting between said die segments, said first predetermined number being greater than two, said die segments each having an internal surface defining a part of said die cavity, first mounting means mounting said pusher member for longitudinal movement with said ram and for lateral movement along a predetermined path relative to said ram between a ram force transmitting position and a laterally disposed position, and second mounting means mounting said first predetermined number of disjuncted die segments and said resilient means on said pusher member for longitudinal movement with said pusher member and said ram into and out of said socket and for lateral movement with said pusher member relative to said ram when said die section is out of said socket, said second mounting means including not more than one deflectable attachment arm extending from said pusher member in a direction toward said bed plate, said attachment arm having a first end rigidly secured to said pusher member at a location remote from said die section and a second end adjacent said die section, aligning means on said second end of said attachment arm aligning said die section in a predetermined position relative to said attachment arm, said second end of said attachment arm being in a free radially outward position relative to said first end when said die section is removed from said socket, and said second end being in a deflected position radially inward of said free radially outward position relative to said first end when said die section is fully received in said socket by operation of said ram to radially inwardly displace said die segments to deform said workpiece.

6. A machine for radially deforming a workpiece as set forth in claim 5 wherein said pusher member includes an inside surface and an outside surface, said first end of said attachment arm is rigidly secured to said inside surface, said attachment arm includes a generally flat C-shaped portion at said second end, and said die section is disposed on said C-shaped portion.

7. A machine for radially deforming a workpiece as set forth in claim 6 wherein said attachment arm includes a longitudinally extending portion disposed circumferentially between adjacent ones of said die segments.

8. A machine for radially deforming a workpiece as set forth in claim 6 wherein said aligning means includes a tab at each end of said C-shaped portion, said tabs each being in a first position relative to said pusher member and being constructed and arranged to secure and align said die section on said attachment arm during said reciprocating movement of said ram, and said tabs each being disposed in a second position longitudinally spaced from said first position during removal of said die section from said attachment arm.

9. A machine for radially deforming a workpiece as set forth in claim 8 wherein said tabs are separate from said C-shaped portion and are resiliently movable relative to said C-shaped portion.

10. A machine for radially deforming a workpiece comprising a bed plate, a ram reciprocate along a longitudinal axis toward and away from said bed plate, a die assembly for receiving said workpiece, said die assembly including a socket and a die section, said die section including a plurality of disjuncted die segments and resilient means acting between adjacent ones of said die segments, said die segments each having an internal surface defining a part of a die cavity, and mounting means mounting said die section for longitudinal movement into and out of said socket by said reciprocable movement of said ram, said mounting means including an attachment arm extending away from said ram in a direction toward said bed plate, said attachment arm having a first end and a second end, said first end being closer to said ram than said second end and said second end being closer to said bed plate than said first end when said ram is in a retracted position, aligning tab means adjacent said second end of said attachment arm securing and aligning said die section in a predetermined position relative to said attachment arm, said aligning tab means being disposed in an obstructing position preventing removal of said die section from said attachment arm during said reciprocating movement of said ram, and said aligning tab means being in an unobstructing position longitudinally spaced from said obstructing position by manual movement of said aligning tab means permitting removal of said die section from said second end of said attachment arm.

11. A machine for radially deforming a workpiece as set forth in claim 10 wherein said attachment arm is deflectable, said second end is in a free radially outward position when said die section is removed from said socket, and said second end is in a deflected position spaced raidally inwardly from said free radially outward position when said die section is fully received in said socket by operation of said ram to radially inwardly displace said die segments to deform said workpiece.

12. A machine for radially deforming a workpiece comprising a bed plate, a ram reciprocable along a longitudinal axis toward and away from said bed plate, a die assembly for receiving said workpiece, a longitudinally extending pusher member disposed between said ram and said die assembly for transmitting ram force to said die assembly, and mounting means mounting said pusher member for longitudinal movement with said ram and for lateral swinging movement relative to said ram about a pivot axis between a ram force transmitting position and a laterally disposed position, said pivot axis being parallel to and spaced from said longitudinal axis, a stationary cam member rigidly secured to said bed plate, said stationary cam member including a longitudinally extending stationary cam surface of smooth arcuate lateral cross section, said stationary cam surface including a first portion of predetermined longitudinal extent having a substantially uniform arcuate cross section for holding said pusher member in said force transmitting position and a second portion of predetermined longitudinal extent having a variable arcuate cross section for defining the lateral swinging movement of said pusher member between said force transmitting position and said laterally disposed position, and a movable follower member carried on said pusher member and biased against said stationary cam surface during said reciprocable movement of said ram.

13. A machine for radially deforming a workpiece as set forth in claim 12 including a spring acting against said pusher member to resiliently bias said movable follower member against said stationary cam surface.

14. A machine for radially deforming a workpiece as set forth in claim 12 wherein the angle which said arcuate extent of said second portion of said stationary cam surface subtends is at least equal to the angle through which said pusher member travels between said force transmitting position and said laterally disposed position.

15. A machine for radially deforming a workpiece comprising a bed plate, a ram reciprocable along a longitudinal axis toward and away from said bed plate, a die assembly for receiving said workpiece, and two longitudinally extending pusher members disposed between said ram and said die assembly, said pusher members each having one end adjacent said ram and another end adjacent to said die assembly, said die assembly including a socket on said bed plate and two die sections, each of said die sections including a plurality of die segments each having an internal surface cooperatively defining a die cavity, mounting means mounting each of said pusher members for longitudinal movement with said ram and for lateral swinging movement relative to said ram about a pivot axis between a laterally disposed position and a ram force transmitting position, connector means connecting each of said die sections on one of said pusher members for longitudinal movement with said pusher member and for lateral swinging movement with said pusher member relative to said ram, said pivot axes each being parallel to and spaced from said longitudinal axis, a stationary cam member rigidly secured to said bed plate, said stationary cam member including a longitudinally extending stationary cam surface of smooth arcuate lateral cross section, said stationary cam surface including a first portion of predetermined longitudinal extent having a substantially uniform cross section for holding said pusher members in said transmitting positions during a portion of the longitudinal movement of said ram when said die sections are in said socket, and a second portion of predetermined longitudinal extent having a variable arcuate cross section for defining said lateral swinging movement of said pusher members between said force transmitting position and said laterally disposed position during a portion of the longitudinal movement of said ram when said die sections are removed from said socket, and a movable follower member carried on each of said pusher members and biased against said stationary cam surface during said reciprocable movement of said ram.

16. A machine for radially deforming a workpiece as set forth in claim 15 wherein the angle which said arcuate extent of said second portion of said stationary cam surface subtends is at least equal to the sum of the angles through which said two pusher members travel between said force transmitting positions and said laterally disposed positions.

* * * * *